US011428086B2

(12) United States Patent
Chen et al.

(10) Patent No.: US 11,428,086 B2
(45) Date of Patent: Aug. 30, 2022

(54) SW-SAGD WITH BETWEEN HEEL AND TOE INJECTION

(71) Applicant: CONOCOPHILLIPS COMPANY, Houston, TX (US)

(72) Inventors: Qing Chen, Houston, TX (US); Wendell P. Menard, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 63 days.

(21) Appl. No.: 17/187,479

(22) Filed: Feb. 26, 2021

(65) Prior Publication Data

US 2021/0180437 A1 Jun. 17, 2021

Related U.S. Application Data

(63) Continuation-in-part of application No. 15/140,136, filed on Apr. 27, 2016, now abandoned.

(60) Provisional application No. 62/153,269, filed on Apr. 27, 2015.

(51) Int. Cl.

| | |
|---|---|
| ***E21B 43/14*** | (2006.01) |
| ***E21B 43/24*** | (2006.01) |
| ***E21B 43/30*** | (2006.01) |

(52) U.S. Cl.

CPC ..... *E21B 43/2406* (2013.01); *E21B 43/14* (2013.01); *E21B 43/305* (2013.01)

(58) Field of Classification Search

CPC ..... E21B 43/2406; E21B 43/305; E21B 43/14
See application file for complete search history.

(56) References Cited

U.S. PATENT DOCUMENTS

| | | | |
|---|---|---|---|
| 4,116,275 | A | 9/1978 | Butler et al. |
| 4,565,245 | A | 1/1986 | Mims et al. |
| 5,167,280 | A | 12/1992 | Sanchez et al. |
| 5,215,149 | A | 6/1993 | Lu |
| 5,626,193 | A | 5/1997 | Nzekwu et al. |
| 6,015,015 | A | 1/2000 | Luft et al. |
| 6,257,334 | B1 | 7/2001 | Cyr et al. |

(Continued)

FOREIGN PATENT DOCUMENTS

| | | |
|---|---|---|
| CA | 2854751 A1 | 5/2014 |
| CN | 204386576 U | 6/2015 |

(Continued)

OTHER PUBLICATIONS

Akhondzadeh, H., et al—"Improving Single Well-SAGD Performance by Applying a New Well Configuration", Apr. 8, 2014, Petroleum Science and Technology, vol. 32, Taylor & Francis Group, pp. 1393-1403, 12 Pages.

(Continued)

*Primary Examiner* — Catherine Loikith
(74) *Attorney, Agent, or Firm* — Boulware & Valoir

(57) ABSTRACT

Single well SAGD is improved by having one or more injection segments and two or more production segments between the toe end and the heel end of a flat, horizontal well. The additional injection points improve the rate of steam chamber development as well as the rate of production, as shown by simulations of a central injection segment bracketed by a pair of production segments (-P-I-P-), and by a pair of injection segments with three production segments (-P-I-P-I-P). Although the completion of the single well costs more, this configuration allows the development of thin plays that cannot be economically developed with traditional SAGD wellpairs.

21 Claims, 9 Drawing Sheets

(56) References Cited

U.S. PATENT DOCUMENTS

| | | | |
|---|---|---|---|
| 8,240,381 | B2 | 8/2012 | Menard et al. |
| 8,528,638 | B2 | 9/2013 | Dong |
| 8,528,639 | B2 | 9/2013 | Fang et al. |
| 8,607,866 | B2 | 12/2013 | Fang et al. |
| 8,607,867 | B2 | 12/2013 | Sarathi et al. |
| 8,967,282 | B2 | 3/2015 | Dreher, Jr. et al. |
| 2010/0326656 | A1 | 12/2010 | Menard |
| 2012/0043081 | A1 | 2/2012 | Kjoerholt |
| 2012/0247760 | A1 | 10/2012 | Wheeler et al. |
| 2012/0273195 | A1 | 11/2012 | Wheeler et al. |
| 2013/0180712 | A1 | 7/2013 | Nasr et al. |
| 2013/0213652 | A1 | 8/2013 | Stalder |
| 2013/0213653 | A1 | 8/2013 | Stalder |
| 2013/0333885 | A1 | 12/2013 | Carrizales et al. |
| 2014/0000888 | A1 | 1/2014 | Kerr |
| 2014/0345855 | A1 | 11/2014 | Wilfing et al. |
| 2014/0345861 | A1 | 11/2014 | Stalder et al. |
| 2015/0053419 | A1 | 2/2015 | Garcia et al. |
| 2015/0107842 | A1 | 4/2015 | Sood et al. |
| 2015/0252657 | A1 | 9/2015 | Dykstra |

FOREIGN PATENT DOCUMENTS

| | | | |
|---|---|---|---|
| WO | 2013075208 | A1 | 5/2013 |
| WO | 2015000065 | A1 | 1/2015 |

OTHER PUBLICATIONS

Elliott, K.T., et al—"Simulation of early-time response of single-well steam assisted gravity drainage (SW-SAGD)", In the Society of Petroleum Engineers, Prepared for presentation of the Western Regional Meeting held in Anchorage, Alaska, May 26-28, 1999, pp. 1-12.

Falk, K., et al., "Concentric CT for Single-Well Steam Assisted Gravity Drainage," World Oil, Jul. 1996, pp. 85-95.

International Search Report mailed in PCT Application No. PCT/US2016/064004 dated Jan. 30, 2017, 2 Pages.

McCormack, M., "Hydraulic Design of Thermal Horizontal Wells," In the Canadian Section SPE/48th Annual Technical Meeting of The Petroleum Society in Calgary, Alberta, Canada, Jun. 8-11, 1997, Paper 97-11.

Singhal, Ashok K., et al—"A Mechanistic Study of Single Well Steam Assisted Gravity Drainage", 2000, SPE-59333, Society of Petroleum Engineers, Prepared for presentation of the 2000 SPE/DOE Improved Oil Recovery Symposium held in Tulsa, OK Apr. 3-5, 2000, pp. 1-24; 24 Pages.

Stalder, J.L., "Cross SAGD (XSAGD)—an Accelerated Bitumen Recovery Alternative, In the SPE Reservoir Evaluation & Engineering"10(1), 2007, pp. 12-18.

Stalder, J.L,"Test of SAGD Flow Distribution Control Liner System", Surmont Field, Alberta, Canada, SPE 153706, Mar. 2012.

Shen, C., "Numerical Investigation of SAGD Process Using a Single Horizontal Well," In the SPE 50412, Nov. 1, 1998, 10 Pages.

SW-SAGD WITH BETWEEN HEEL AND TOE INJECTION

PRIOR RELATED APPLICATIONS

This application is a continuation-in-part of Ser. No. 15/140,136, filed Apr. 27, 2016, which claims benefit under 35 USC § 119(e) to U.S. Provisional Application Ser. No. 62/153,269 filed Apr. 27, 2015, each of which is incorporated herein in its entirety.

FEDERALLY SPONSORED RESEARCH STATEMENT

Not applicable.

FIELD OF THE DISCLOSURE

This disclosure relates generally to methods that can advantageously produce oil using steam-based mobilizing techniques. In particular, it relates to improved single well gravity drainage techniques with better steam chamber development and faster oil production than previously available.

REFERENCE TO MICROFICHE APPENDIX

Not applicable.

BACKGROUND OF THE DISCLOSURE

Oil sands are a type of unconventional petroleum deposit, containing naturally occurring mixtures of sand, clay, water, and a dense and extremely viscous form of petroleum technically referred to as "bitumen," but which may also be called heavy oil or tar. Bitumen is so heavy and viscous (thick) that it will not flow unless heated or diluted with lighter hydrocarbons. At room temperature, bitumen is much like cold molasses, and the viscosity can be in excess of 1,000,000 cP.

Due to their high viscosity, these heavy oils are hard to mobilize, and they generally must be heated in order to produce and transport them. One common way to heat bitumen is by injecting steam into the reservoir. Steam Assisted Gravity Drainage or "SAGD" is the most extensively used technique for in situ recovery of bitumen resources in the McMurray Formation in the Alberta Oil Sands.

In a typical SAGD process, two horizontal wells (known as a 'wellpair') are stacked one over the other and vertically spaced by 4 to 10 meters (m). See FIG. 1. The production well is located near the bottom of the pay and the steam injection well is located directly above and parallel to the production well. Steam is injected continuously into the injection well, where it rises in the reservoir and forms a steam chamber. With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity segregation within steam chamber.

The use of gravity gives SAGD an advantage over conventional steam injection methods. SAGD employs gravity as the driving force and the heated oil remains warm and movable when flowing toward the production well. In contrast, conventional steam injection displaces oil to a cold area, where its viscosity increases and the oil mobility is again reduced.

Although quite successful, SAGD does require large amounts of water in order to generate a barrel of oil. Some estimates provide that 1 barrel of oil from the Athabasca oil sands requires on average 2 to 3 barrels of water, and it can be much higher, although with recycling the total amount can be reduced. In addition to using a precious resource, additional costs are added to convert those barrels of water to high quality steam for down-hole injection and to clean produced water for reuse. Therefore, any technology that can reduce water or steam consumption has the potential to have significant positive environmental and cost impacts.

Additionally, SAGD is less useful in thin stacked payzones, because thin layers of impermeable rock in the reservoir block the expansion of the steam chamber leaving only thin zones accessible, thus leaving the oil in other layers behind. Further, the wells need a vertical separation of about 4-5 meters in order to maintain the steam trap. In wells that are closer, live steam can break through to the producer well, resulting in enlarged slots that permit significant sand entry, and cause well shutdowns and damage to equipment.

Indeed, in a paper by Shin & Polikar (2005), the authors simulated reservoir conditions to determine which reservoirs could be economically exploited. The simulation results showed that for Cold Lake-type reservoirs, a net pay thickness of at least 20 meters was required for an economic SAGD implementation. A net pay thickness of 15 meters was still economic for the shallow Athabasca-type reservoirs because of the high permeability of this type of reservoir, despite the very high bitumen viscosity at reservoir conditions. In Peace River-type reservoirs, net pay thicker than 30 meters was expected to be required for a successful SAGD performance due to the low permeability of this type of reservoir. The results of the study indicate that the shallow Athabasca-type reservoir, which is thick with high permeability (high loch), is a good candidate for SAGD application, whereas Cold Lake and Peace River-type reservoirs, which are thin with low permeability, are not as good candidates for conventional SAGD implementation.

In order to address the thin payzone issue, some petroleum engineers have proposed a single wellbore steam assisted gravity drainage or "SW-SAGD." See e.g., FIG. 2A. In SW-SAGD, a horizontal well is completed and assumes the role of both injector and producer. In a typical case, steam is injected at the toe of the well, while hot reservoir fluids are produced at the heel of the well, and a thermal packer is used to isolate steam injection from fluid production (FIG. 2A).

Another version of SW-SAGD uses no packers, simply tubing to segregate flow. Steam is injected at the end of the horizontal well (toe) through an isolated concentric coiled tubing (ICCT) with numerous orifices. In FIG. 2B a portion of the injected steam and the condensed hot water returns through the annulus to the well's vertical section (heel). The remaining steam, grows vertically, forming a chamber that slowly expands toward the heel, heating the oil, lowering its viscosity and draining it down the well's annular by gravity, where it is pumped up to the surface through a second tubing string.

Advantages of SW-SAGD might include cost savings in drilling and completion and utility in relatively thin reservoirs where it is not possible to drill two vertically spaced horizontal wells. Basically since there is only one well, instead of a well pair, drilling costs are only half that of conventional SAGD. However, the process is technically challenging and the method seems to require even more steam than conventional SAGD.

Field tests of SW-SAGD are not extensively documented in the literature, but the available evidence suggests that there is considerable room to optimize the SW-SAGD process.

For example, Falk overviewed the completion strategy and some typical results for a project in the Cactus Lake Field, Alberta Canada. A roughly 850 meter long well was installed in a region with 12 to 16 meter of net pay to produce 12° API gravity oil. The reservoir contained clean, unconsolidated, sand with 3400 md permeability. Apparently, no attempts were made to preheat the reservoir before initiation of SW-SAGD. Steam was injected at the toe of the well and oil produced at the heel. Oil production response to steam was slow, but gradually increased to more than 100 $m^3$/d. The cumulative steam-oil ratio was between 1 and 1.5 for the roughly 6 months of reported data.

McCormack also described operating experience with nineteen SW-SAGD installations. Performance for approximately two years of production was mixed. Of their seven pilot projects, five were either suspended or converted to other production techniques because of poor production. Positive results were seen in fields with relatively high reservoir pressure, relatively low oil viscosity, significant primary production by heavy-oil solution gas drive, and/or insignificant bottom-water drive. Poor results were seen in fields with high initial oil viscosity, strong bottom-water drive, and/or sand production problems. Although the authors noted that the production mechanism was not clearly understood, they suspected that the mechanism was a mixture of gravity drainage, increased primary recovery because of near wellbore heating via conduction, and hot water induced drive/drainage.

Moriera (2007) simulated SW-SAGD using CMG-STARS, attempting to improve the method by adding a pre-heating phase to accelerate the entrance of steam into the formation, before beginning a traditional SW-SAGD process. Two processes were modeled, as well as conventional SW-SAGD and dual well SAGD. The improved processes tested were 1) Cyclic injection-soaking-production repeated three times (20, 10 and 30 days for injection, soaking and production respectively), and 2) Cyclic injection repeated three times as in 1), but with the well divided into two portions by a packer, where preheat steam was injected at the toe and center and circulated throughout the well, but production occurring only in the producing heel half with toe steam injection.

They found that the cyclical preheat period provided better heat distribution in the reservoir and reduced the required injection pressure, although, it increased the waiting time for the continuous injection process. Additionally, the division of the well by a packer and the injection of the steam in two points, in the middle and at the extremity of the well, helped the distribution of the heat in the formation and favor oil recovery in the cyclical injection phase. They also found that in the continuous injection phase, the division of the well induced an increase of the volume of the steam chamber, and improved the oil recovery in relation to the SW-SAGD process. Also, an increase of the blind interval (blank pipe), between the injection and production passages, increased the difference of the pressure and drove the displaced oil in the injection section into the production area, but caused imprisonment of the oil in the injection section, reducing the recovery factor.

Overall, the authors concluded that modifications in SW-SAGD operation strategies can lead to better recovery factors and oil steam ratios than those obtained with the dual well SAGD process, but that SW-SAGD performance was highly variable.

It is noted that these authors did use central (and toe) injection during the preheat or startup phase. However, the steam was allowed to travel the length of the well, thus the entire well was preheated. Further, actual production phase was the same as usual, with toe injection and heel production. Since the steam was only injected at the toe segment, it is expected that the oil from the steam end, at least part of it, was not recoverable.

Although beneficial, the SW-SAGD methodology could be further developed to further improve its cost effectiveness. This application addresses some of those needed improvements.

SUMMARY OF THE DISCLOSURE

The conventional SW-SAGD utilizing one single horizontal well to inject steam into reservoir through toe and produce liquid (oil and water) through mid and heel of the well has potential for thin-zone applications where placing two horizontal wells with 5 m vertically apart required in the SAGD method is both technically and economically challenging. SW-SAGD, however, exhibits several disadvantages leading to slow steam chamber growth and low oil rate.

First of all, SW-SAGD is not efficient in developing the steam chamber. Due to the arrangement of injection and production points in the conventional SW-SAGD, the steam chamber can grow only on one side towards the heel. In other words, only one half of the surface area surrounding the steam chamber is available for heating and draining oil.

Secondly, a large portion of the horizontal well length perforated for production does not actually contribute to oil production until the steam chamber expands over the whole length. This is particularly true during the early stage where only a small portion of the well close to the toe collects oil.

This disclosure proposes instead to use variations of steam injection point location and number to improve the recovery performance. The essential idea of the invention is to allow full development of steam chamber from both sides and increase the effective production well length.

FIG. 3 shows schematically a simple, but effective (as demonstrated later by simulation) process modified from the conventional SW-SAGD, in which the steam injection point is placed in the middle of the horizontal well. The toe and heel sections of the horizontal well, isolated from the steam injection portion by thermal packers within the wellbore, are perforated and serve as producer wells to collect oil and condensed water. Thus, we have central steam injection bracketed by two production zones in the flat horizontal well shown in FIG. 3.

As illustrated in FIG. 3, the steam chamber can now grow from both sides, with the effective thermal and drainage interfaces virtually doubled. Consequently, the effective production well length is doubled, resulting in a significant uplift in oil production rate. To further improve the performance SW-SAGD, multiple steam injection points can be introduced into the wellbore to initiate and grow a serial of steam chambers simultaneously.

FIG. 4 gives an example with two injection points, one at ¼ well length from the heel and the other ¾ well length from the heel in this flat horizontal well. The SW-SAGD with multiple steam injection points can significantly accelerate the oil recovery by engaging more well length into effective production. The number of the steam injection points and intervals between them normally need to be determined and optimized based on the reservoir properties and economics.

It is worth pointing out that implementing center or multi-injection points within a single wellbore adds complexity to the wellbore design, and consequently well cost (as compared to standard SW-SAGD). For example, the well completion will require packers on either side of the steam injection points, and the ICCT will require additional outlets for steam if multi-point injection methods are used. Nevertheless, the proposed invention presents a big potential, and the increased cost is incremental as compared with the cost of saving in injector well drilling. Further, as shown in FIGS. 7 and 8, the increased recovery herein is a likely game-changer for SW-SAGD applications, especially as applied to thin-zone bitumen reservoirs.

The method is otherwise similar to SAGD, which requires steam injection (often in both wells of the wellpair) to establish fluid communication between wells (not needed here) as well as a steam chamber. When the steam chamber is well developed, injection proceeds in only the injectors, and production begins at the producer. Alternatively, the startup or preheat period can be reduced in SW-SAGD.

Although a preheat or startup phase can be reduced (or even eliminated) in this multi- or central-injection point SW-SAGD, preferably the method includes cyclic steam preheat phases, wherein steam is injected throughout both injector and producer segments (e.g., the entire horizontal length of the well), for e.g. 20-50 days, then allowed to soak into the reservoir, e.g., for 10-30 days, and this preheat phase is repeated two or preferably three times. This ensures adequate steam chamber growth along the length of the well.

Also preferred, the steam injection (in either or both phases) can be combined with solvent injection or noncondensable gas injection, such as $CO_2$, as solvent dilution and gas lift can assist in recovery.

Once the well length is preheated, the well is then converted to the desired configuration (e.g., by adding or expanding the packers) or through the use of flow control devices and the method proceeds as described.

The invention can comprise any one or more of the following embodiments, in any combination(s) thereof:

An improved method of producing heavy oils from a SW-SAGD, wherein steam in injected into a toe end of a horizontal well to mobilize oil which is then produced at a heel end of said horizontal well, the improvement comprising providing one or more injection points for steam between said heel end and said toe end, thus improving a CSOR of said horizontal well at a time period as compared to a similar well with steam injection only at said toe end.

A method of producing heavy oils from a reservoir by single well steam and gravity drainage (SW-SAGD), comprising: providing a horizontal well below a surface of a reservoir; said horizontal well having a toe end and a heel end and a middle therebetween; injecting steam into one or more injection points between said toe end and said heel end; and simultaneously (with said steam injection) producing mobilized heavy oil; wherein said method produces more oil at a time point than a similar SW-SAGD well with steam injection only at said toe.

A well configuration for producing heavy oils from a reservoir by single well steam and gravity drainage (SW-SAGD), comprising: a horizontal well in a subsurface reservoir; said horizontal well having a toe end and a heel end and having at least three segments comprising: at least two production segments bracketing at least one injection segment; said production segments fitted for production; and said injection segments fitted for injection.

A method or configuration as herein described, wherein each injection point is separated from a production segment by at least two thermal packers.

A method or configuration as herein described, wherein an injection point is at said middle.

A method or configuration as herein described, wherein two injection points are at about ¼ and ¾ of a horizontal length of said well.

A method or configuration as herein described, said at least two injection segments fitted with tubing having two orifices to inject steam into said two injection segments.

A method as herein described, wherein production and injection take place simultaneously.

A method as herein described wherein injected steam includes solvent.

A method as herein described wherein said method includes a preheating phase wherein steam is injected along the entire length of the well.

A method or configuration as herein described wherein said method includes a cyclic preheating phase comprising a steam injection period along the entire length of the well followed by a soaking period.

A method as herein described wherein said method includes a pre-heating phase comprising a steam injection in both the injection segment(s) and the production segment(s) followed by a soaking period.

Preferably, two or three cyclic preheating phases are used. Preferably the soaking period is 10-30 days or about 20 days.

"SW-SAGD" as used herein means that a single well serves both injection and production purposes, but nonetheless there may be an array of SW-SAGD wells to effectively cover a given reservoir. This is in contrast to conventional SAGD where the injection and production wells are separate during production phase, necessitating a wellpair at each location.

As used herein, "preheat" or "startup" is used in a manner consistent with the art. In SAGD the preheat stage usually means steam injection throughout both wells until the steam chamber is well developed and the two wells are in fluid communication. Thus, both wells are fitted for steam injection. Later during production, the production well is fitted for production, and steam injected into the injector well only. In SW-SAGD, the meaning is the same, except that there is only a single well. Thus, preheat means steam injection throughout the well (e.g., no packers) in order to develop a steam chamber along the entire length of the well.

As used herein, "cyclic preheat" is used in a manner consistent with the art, wherein the steam is injected, preferably throughout the entire horizontal length of the well, and left to soak for a period of time, and any oil collected. Typically the process is then repeated two or more times. Steam injection throughout the length of the well can be achieved herein by merely removing or opening packers, such that steam travels the length of the well, exiting any slots or perforations used for production. The well is then converted back to both injection and production by adding packers or closing pre-placed packers, or otherwise segregating the flow.

As used wherein, a "production phase" is that phase where steam injection and production occur simultaneously, and is understood in the art to be different from a "preheat"

or "startup" phase, where steam is injected for preheat purposes and the well configuration is different. The invention herein relates to steam injection during production phase that occurs at one or more locations between the heel and toe. Since there is only a single well, packers are typically required to separate the steam injection and production segments so that they can occur simultaneously.

After preheat or cyclic preheat, the well is used for production, and steam injection occurs only at the points designated hereunder, with packers and preferably with blank pipe separating injection section(s) from production sections. The blank pipe, with relatively short length or preferably controllable length during operation, may help provide differential pressure and thus minimize steam breakthrough at the production section. Injection sections need not be large herein, and can be on the order of <1-100 m, or 1-50 m or 20-40.

The ideal length of blank pipe will vary according to reservoir characteristics, oil viscosity as well as injection pressures and temperatures, but a suitable length is in the order of 10-40 feet or 20-30 feet of blank liner. It may also be possible to use a sliding sleeve and thus allow the benefits of a blind interval, yet still recover the oil behind the blind interval by sliding the sleeve in one direction or the other, thus sliding the blind interval. Using sliding injection/production segments means little to no oil will be lost in any blind interval behind blank pipes or in injector sections, thus overall oil recovery will increase as compared to a similar well lacking sliding sleeves or their equivalent. It may also be possible to substitute FCDs for the blind pipe or combine them therewith.

A suitable arrangement might thus be a 300-500 meter long production passage, 10-40 meter blind interval, packer, <1-40 meter long injection passage followed by another packer, 10-40 meter blind interval and 300-500 meter production passage. Another arrangement might have two injection points: 300 meter production, 10-20 blind interval, packer, 1-10 injection, packer, 10-20 blind interval, 600 meter production, 10-20 blind interval, packer, 1-10 m injection, packer, 10-20 blind interval, 300 meter production. Yet another arrangement might be 200 meter production, 10-20 blind interval, packer, 1-10 injection, packer, 10-20 blind interval, 400 meter production, 10-20 blind interval, packer, 1-10 m injection, packer, 10-20 blind interval, 400 meter production, 10-20 blind interval, packer, 1-10 injection, packer, 10-20 blind interval, and 200 meter production.

By "heel end" herein we include the first joint in the horizontal section of the well, closest the vertical section, or the first two joints.

By "toe end" herein we include the last joint in the horizontal section of the well, or the last two joints.

By "middle" herein we refer to 25-75% of the horizontal well length, but preferably from 40-60% or 45-55%.

By "between the toe end and the heel end", we mean an injection point that lies between the first and last joint or two of the ends of the horizontal portion of the well.

As used herein, flow control device "FCD" refers to all variants of tools intended to passively control flow into or out of well bores by choking flow (e.g., creating a pressure drop). The FCD includes both inflow control devices "ICDs" when used in producers and outflow control devices "OCDs" when used in injectors. The restriction can be in form of channels or nozzles/orifices or combinations thereof, but in any case the ability of an FCD to equalize the inflow along the well length is due to the difference in the physical laws governing fluid flow in the reservoir and through the FCD. By restraining, or normalizing, flow through high-rate sections, FCDs create higher drawdown pressures and thus higher flow rates along the bore-hole sections that are more resistant to flow. This corrects uneven flow caused by the heel toe effect and heterogeneous permeability.

As used herein, a "sliding sleeve" is a device used in well completions that allows orifices to be moved up or down the device, thus "sliding" the openings along the well and thereby controlling the flow into or out of the well at that zone. The term "sliding" does not imply a mechanism, however, and rotation, electronics, hydraulics and other methods can be used to move the openings, in addition to sliding type mechanisms.

There are two main categories of sliding sleeves: open/close and choking. Open/close sleeves are shifted between a full open position and a closed position. They are used to shut off flow from a zone for economic reasons or to shut off a zone that is depleting or producing too much water. In multi-zone wells, they are used to regulate which zones to produce from and which ones to shut off Mechanically actuated sleeves are simple and inexpensive but require actuation by a "lock," which must be run in the well on wireline or coiled tubing. Hydraulically actuated sleeves are more complicated but can be actuated from a small pump at surface. King sleeves can be used to regulate the pressure between two or more zones. They are also used to regulate the flow of fluid into a well during proppant fracturing or hydraulic fracturing operations. Choking sleeves are all hydraulically actuated and have a much more complex design than open/close sleeves.

Many oilfield service companies make sliding sleeves, e.g., Sliding Sleeve CT-CMD-NE by COMPLETION OIL TOOLS®; CMD and CD-6000 by BAKER HUGHES®; AS-3, CS-1, and CS-3 series by SCHLUMBERGER®; SLXO by EVOLUTION OIL TOOLS®; and the DURASLEEVE® SLIDING SIDE-DOOR® Circulation and Production Sleeve by HALLIBURTON® to name few.

By "providing" a well, we mean to drill a well or use an existing well. The term does not necessarily imply contemporaneous drilling because an existing well can be retrofitted for use, or used as is.

By being "fitted" for injection or production what we mean is that the completion has everything is needs in terms of equipment needed for injection or production.

By "injection segment" we mean a portion of the well that is fitted for injection, e.g., with injection FCDs, or injection tubing, slots, and the like, that is bounded by the end of the well or by a production segment.

By "production segment" we mean a portion of the well that is fitted for production, e.g., with production FCDs, or slotted liners, pumps, and the like, that is bounded by the end of the well or by an injection segment. Injection segments can be converted to production segments, and often are after start up.

Production and injections segments are typically separated by packers and by one or two lengths of blank tubing, but it is also to replace or combine blanks with FCD use and/or sliding sleeves.

"Vertical" drilling is the traditional type of drilling in oil and gas drilling industry, and includes any well<45° of vertical.

"Horizontal" drilling is the same as vertical drilling until the "kickoff point" which is located just above the target oil or gas reservoir (pay-zone), from that point deviating the drilling direction from the vertical to horizontal. By "horizontal" what is included is an angle within 45° (:S45°) of horizontal. Of course every horizontal well has a vertical portion to reach the surface, but this is conventional, understood, and typically not discussed.

By "flat" herein we mean generally flat, such as is as shown in FIGS. 3 and 4, but potentially including minor, unintentional deviations cause by drilling imperfections. In one embodiment the well bore follows the contours of the lower reservoir boundary. In another embodiment the well bore has a slight incline from the heel to the toe. In yet another embodiment the well bore declines from the heel to the toe. Intentionally undulating wells, such as described in Dykstra (US20150252657) are excluded as such modifications would make production difficult and may inhibit the flow of oil from the toe to the heel of the well.

A "perforated liner" or "perforated pipe" is a pipe having a plurality of entry-exits holes throughout for the exit of steam and entry of hydrocarbon. The perforations may be round or long and narrow, as in a "slotted liner," or any other shape.

A "blank pipe" or "blank liner" is a joint that lacks any holes.

A "packer" refers to a downhole device used in almost every completion to isolate the annulus from the production conduit, enabling controlled production, injection or treatment. A typical packer assembly incorporates a means of securing the packer against the casing or liner wall, such as a slip arrangement, and a means of creating a reliable hydraulic seal to isolate the annulus, typically by means of an expandable elastomeric element. Packers are classified by application, setting method and possible retrievability.

A "joint" is a single section of pipe.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| | |
|---|---|
| Bbl | Oil barrel, bbls is plural |
| CP SW-SAGD | Center point injection SW-SAGD |
| CSOR | Cumulative Steam to oil ratio |
| CSS | Cyclic steam stimulation |
| DW-SAGD | dual well SAGD |
| ES-SAGD | Expanding solvent-SAGD |
| FCD | Flow control device |
| MPSW-SAGD | MULTI-Point SW-SAGD |
| OOIP | Original Oil in Place |
| SAGD | Steam assisted gravity Drainage |
| SD | Steam drive |
| SOR | Steam to oil ratio |
| SW-SAGD | Single well SAGD |

DESCRIPTION OF EMBODIMENTS

The present disclosure provides a novel well configurations and method for SW-SAGD.

This novel modification to the conventional single-well SAGD (SW-SAGD) process varies the location and number of steam injection points during the production phase, and the same points can be used in preheat or cyclic preheat.

The conventional SW-SAGD process grows a steam chamber and drains oil by gravity by utilizing one single horizontal well with steam injected only at the toe and liquid produced through the rest of the well. SW-SAGD has potential to unlock vast thin-zone (<5-20 meter pay) oil sand resources where SAGD using well pairs is economically and technically challenging.

However, the conventional SW-SAGD normally suffers from slow steam chamber growth and low oil production rate as the steam chamber can only grow from toe gradually towards the heel. This is ineffective, and seriously limits the usefulness of SW-SAGD.

In this invention, we propose an improved SW-SAGD process with one or more steam injection points between the toe and heel end. For example, a center steam injection point can be used, or multiple steam injection points spaced for equal steam chamber development can be used to significantly accelerate steam chamber growth and oil recovery. The superior recovery performance of the proposed configuration and methods is confirmed by our simulation results.

It is surprising that this elegant solution to the low production level issue with SW-SAGD has never been proposed before. However, one reason is that most SAGD simulations are either run as 2D cross-sections, or as 3D models with relatively large gridding in the wellbore direction (typically 25-100 m), both of which will either eliminate the "end effect" (in the case of 2D simulations), or seriously under-estimate it (in the case of large-block 3D simulations). Thus, given the tools typically available to the petroleum engineer, even if the idea was attempted, traditional models would not show any benefit.

Conventional SW-SAGD

Figure 1A:
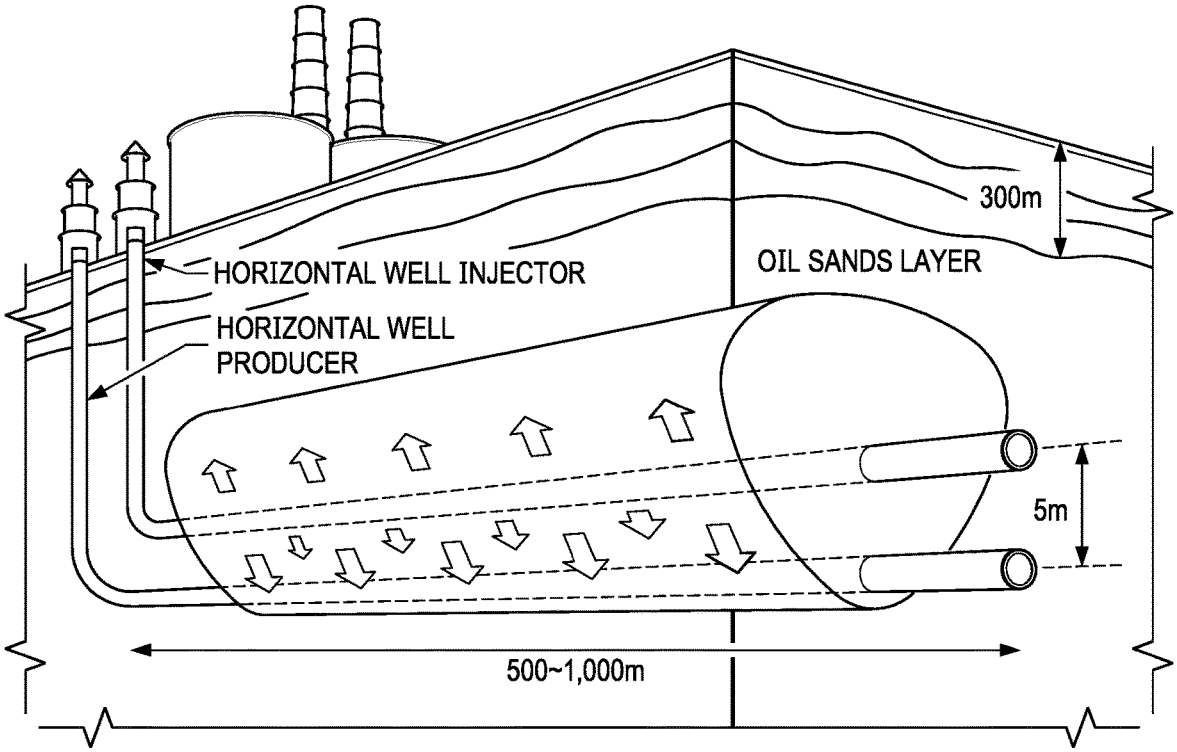
FIG. 1A (PRIOR ART)
FIG. 1A shows traditional SAGD wellpair, with an injector well a few meters above a producer well.
Figure 1B:
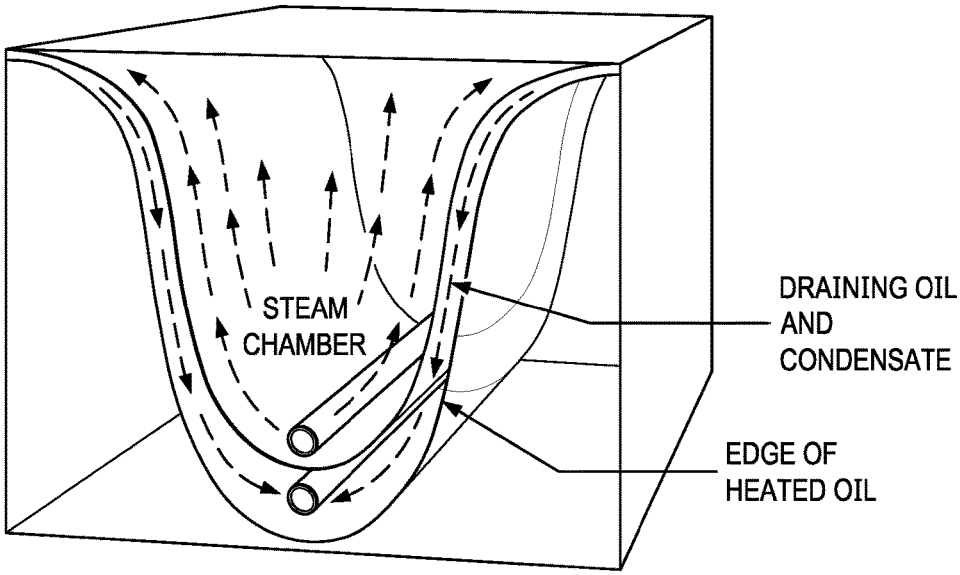
FIG. 1B (PRIOR ART)
FIG. 1B shows a typical steam chamber.
Figure 2A:
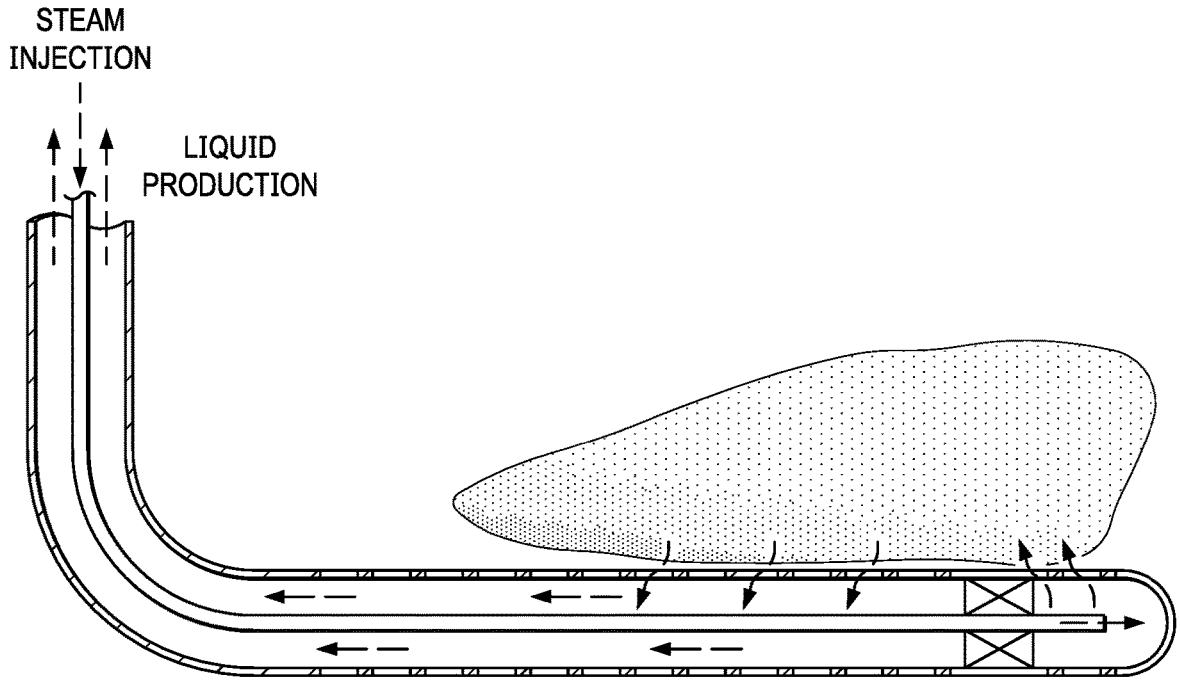
FIG. 2A (PRIOR ART)
FIG. 2A shows a SW-SAGD well, wherein the same well functions for both steam injection and oil production. Steam is injected into the toe (in this case the toe is updip of the heel), and the steam chamber grows towards the heel. Steam control is via packer.
Figure 2B:
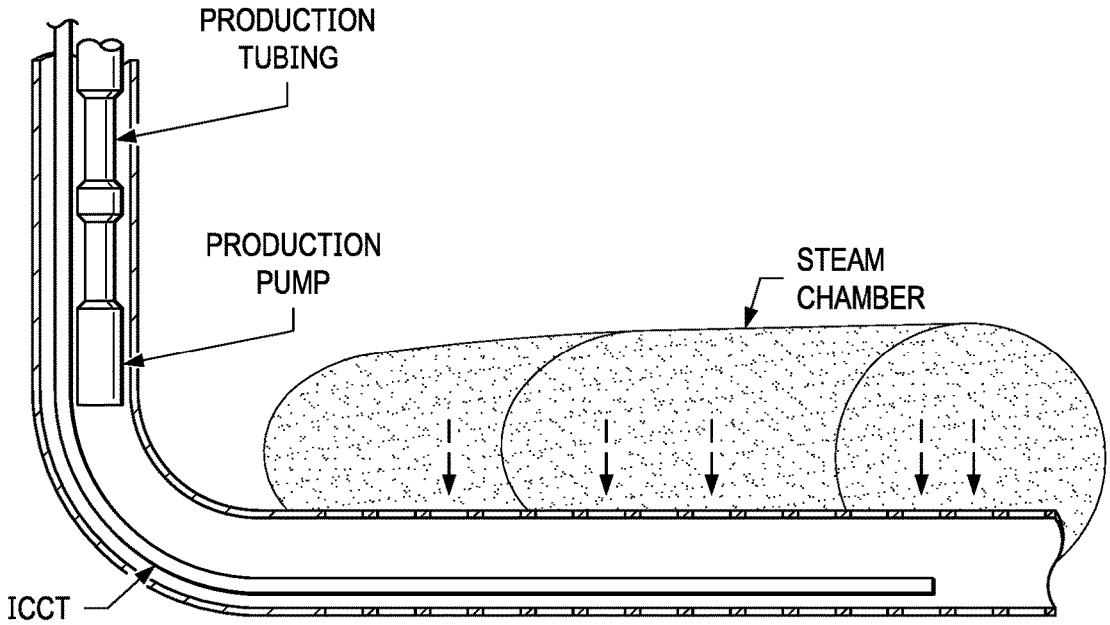
FIG. 2B (PRIOR ART)
FIG. 2B shows another SW-SAGD well configuration wherein steam is injected via ICCT, and a second tubing is provided for hydrocarbon removal.

The conventional SW-SAGD utilizes one single horizontal well to inject steam into reservoir through toe and produce liquid (oil and water) through mid and heel of the well, as schematically shown in FIGS. 2A and B. A steam chamber is expected to form and grow from the toe of the well. Similar to the SAGD process, the oil outside of the steam chamber is heated up with the latent heat of steam, becomes mobile, and drains with steam condensate under gravity towards the production portion of the well. With continuous steam injection through toe and liquid production through the rest of the well, the steam chamber expands gradually towards the heel to extract oil.

Due to the unique arrangement of injection and production, the SW-SAGD can also benefit from pressure drive in addition to gravity drainage as the recovery mechanisms. Also, compared with its counterpart, the traditional dual well or "DW-SAGD" configuration, SW-SAGD requires only one well, thereby saving almost half of well cost. SW-SAGD becomes particularly attractive for thin-zone applications where placing two horizontal wells with the typical 4-10 m vertical separation required in SAGD is technically and economically challenging.

SW-SAGD, however, exhibits several disadvantages leading to slow steam chamber growth and low oil rate. First of all, SW-SAGD is not efficient in developing the steam chamber. The steam chamber growth depends largely upon the thermal conduction to transfer steam latent heat into cold reservoir and oil drainage under gravity along the chamber interface. Due to the arrangement of injection and production points in the conventional SW-SAGD, the steam chamber can grow only direction towards the heel. In other words, only one half of the surface area surrounding the steam chamber is available for heating and draining oil. Secondly, a large portion of the horizontal well length perforated for production does not actually contribute to oil production until the steam chamber expands over the whole length. This is particularly true during the early stage where only a small portion of the well close to the toe collects oil. Third, toe oil may be lost as the toe is fitted only for injection, not production.

CPSW-SAGD

To overcome the aforementioned issues associated with the conventional SW-SAGD, we propose steam injection in between the heel and toe to improve the recovery performance at about the center of the well. By "center" herein, we refer to roughly the center of the longitudinal portion of the well, and do not consider the vertical portion. By doing this, the steam chamber can grow in both directions from roughly the middle. The essential idea is to allow full development of steam chamber from both sides and increase the effective production well length earlier in the process.

Figure 3:
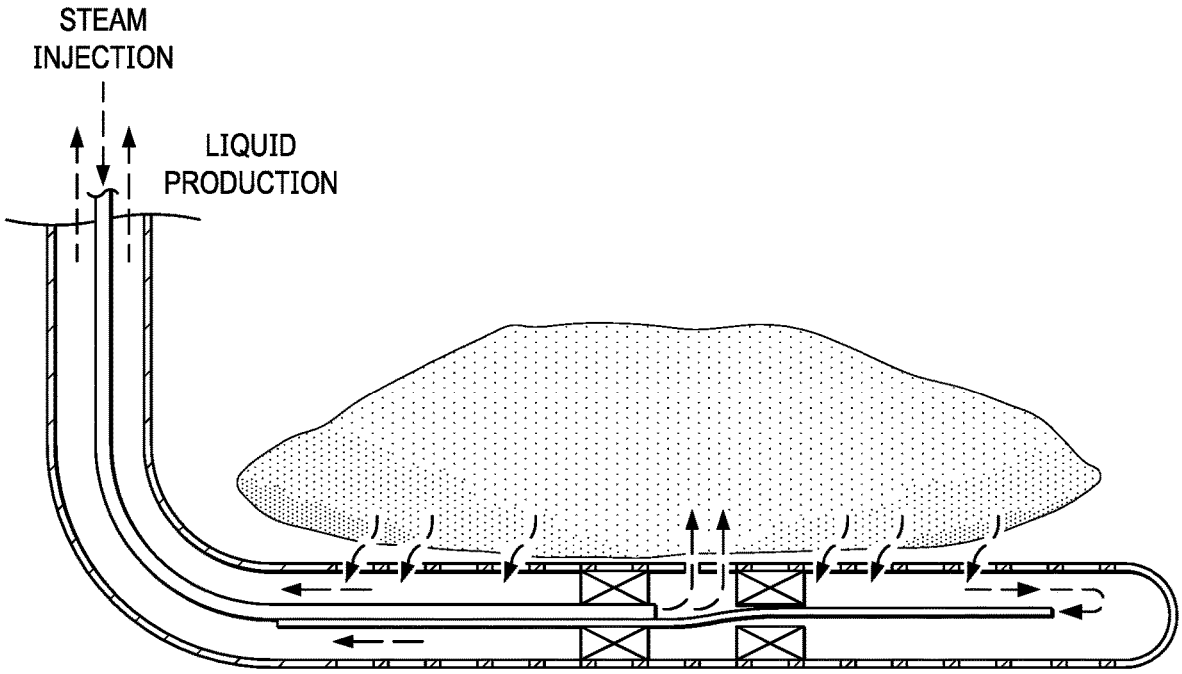
FIG. 3 illustrates center point injection SW-SAGD (CPSW-SAGD).
Figure 4A:
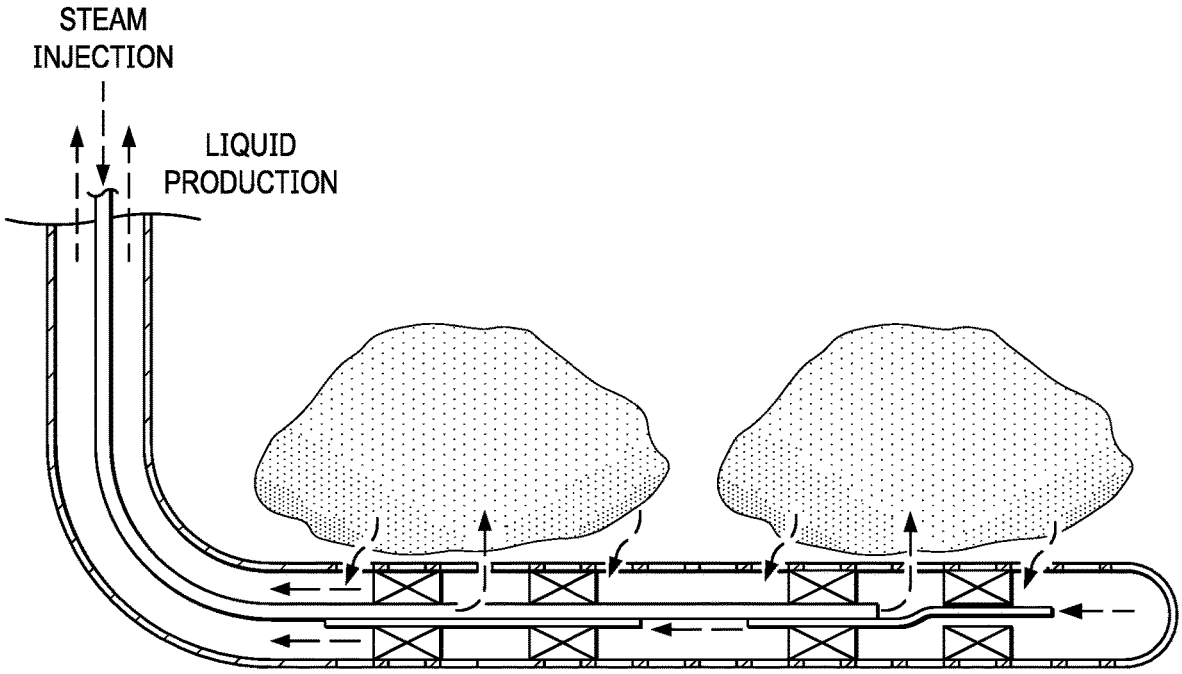
FIG. 4A is multi-point injection SW-SAGD (MPSW-SAGD). One injection point is situated at ¼ well length from the heel and the other is ¾ well length from the heel, and each steam chamber grows in both directions, meeting in the middle of the well.
Figure 4B:
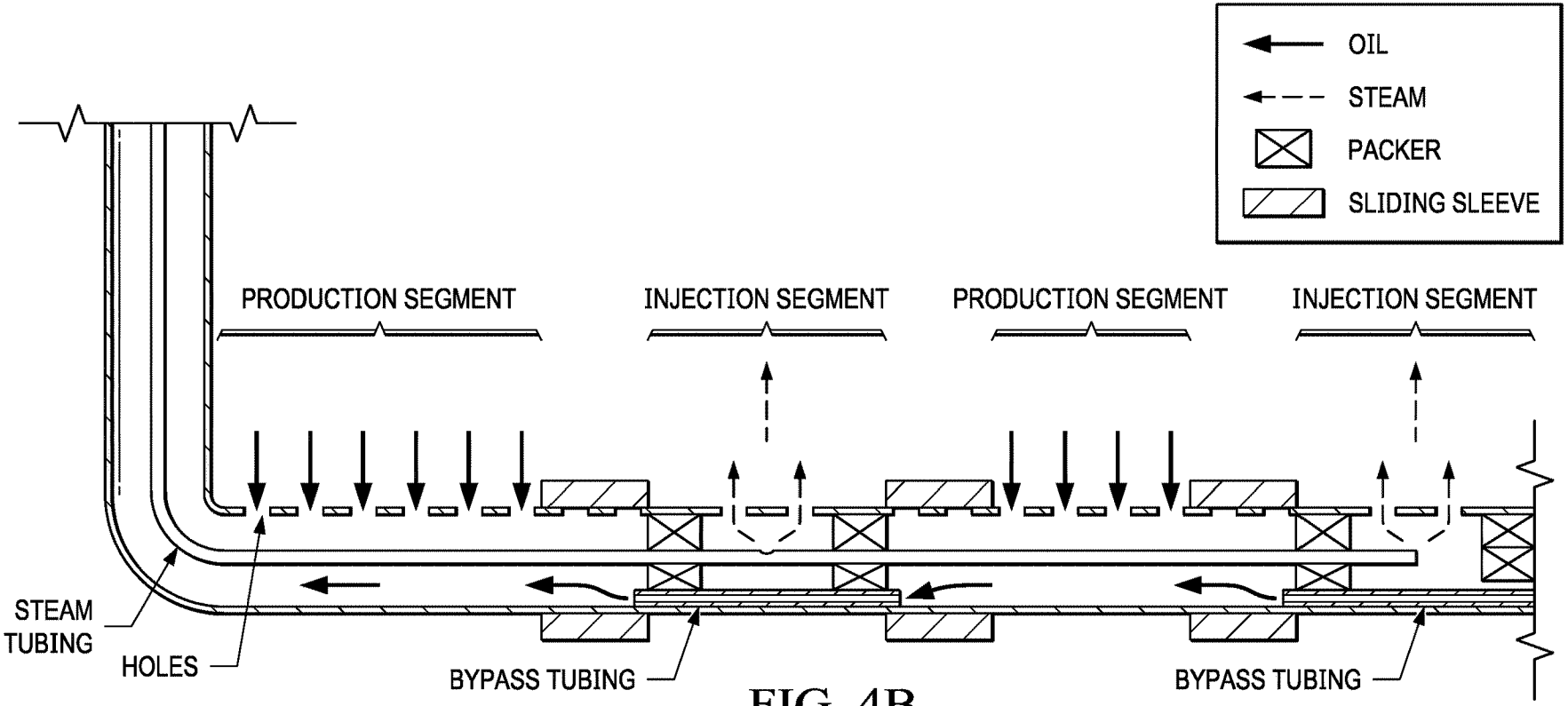
FIG. 4B and FIG. C show sliding sleeve use, wherein the sliding sleeves are moved in 4C to uncover some of the blind spots in 4B and allow more oil production. Note these figures are not drawn to scale, and due to size constraints only a small amount of movement (one hole) is shown. Significant additional movement is possible though, especially when combined with packer opening/closing and/or movement or addition of packers and/or FCD use.
Figure 4C:
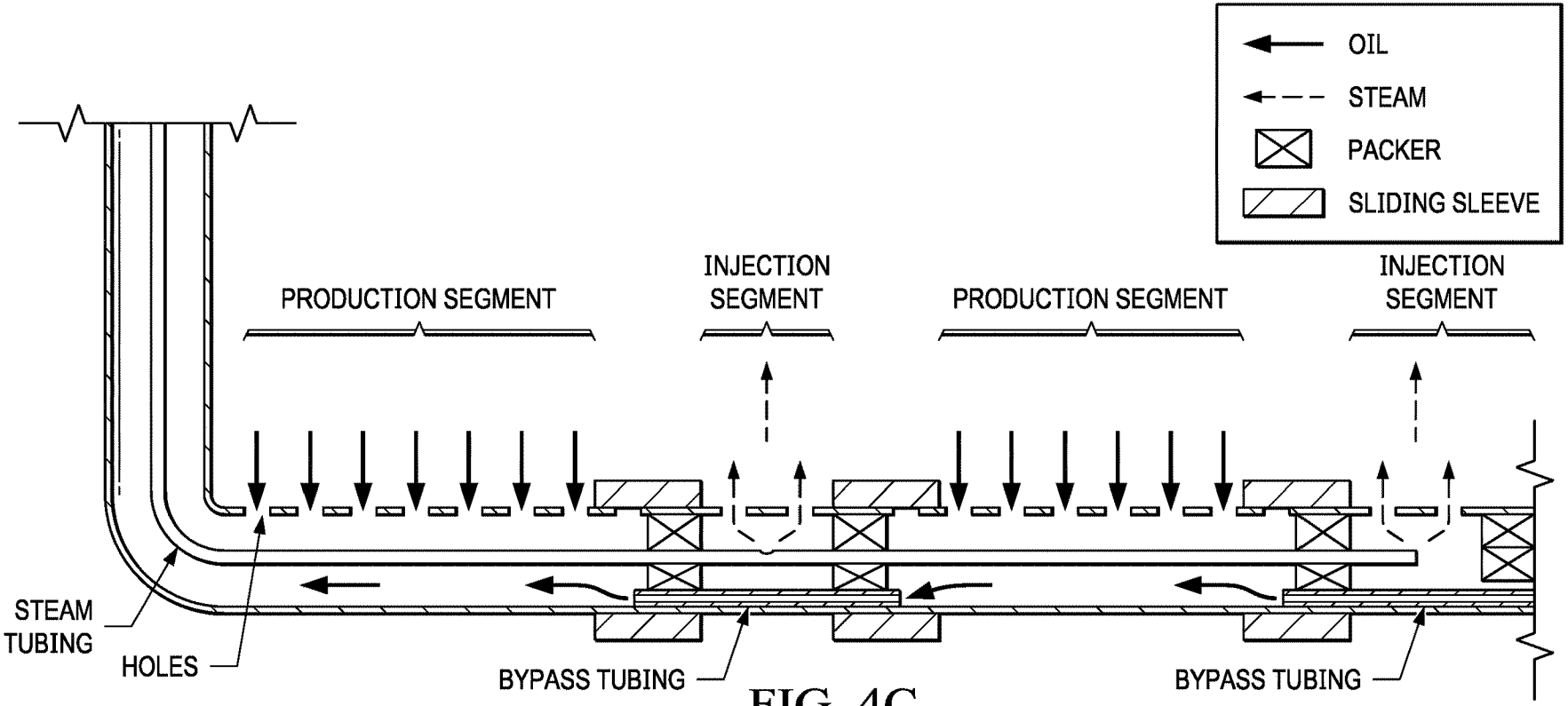
FIG. 4D is similar to 4A, but complete tubing is used for production and injection, as opposed to the bypass production tubing shown in FIG. 4A.
Figure 4D:
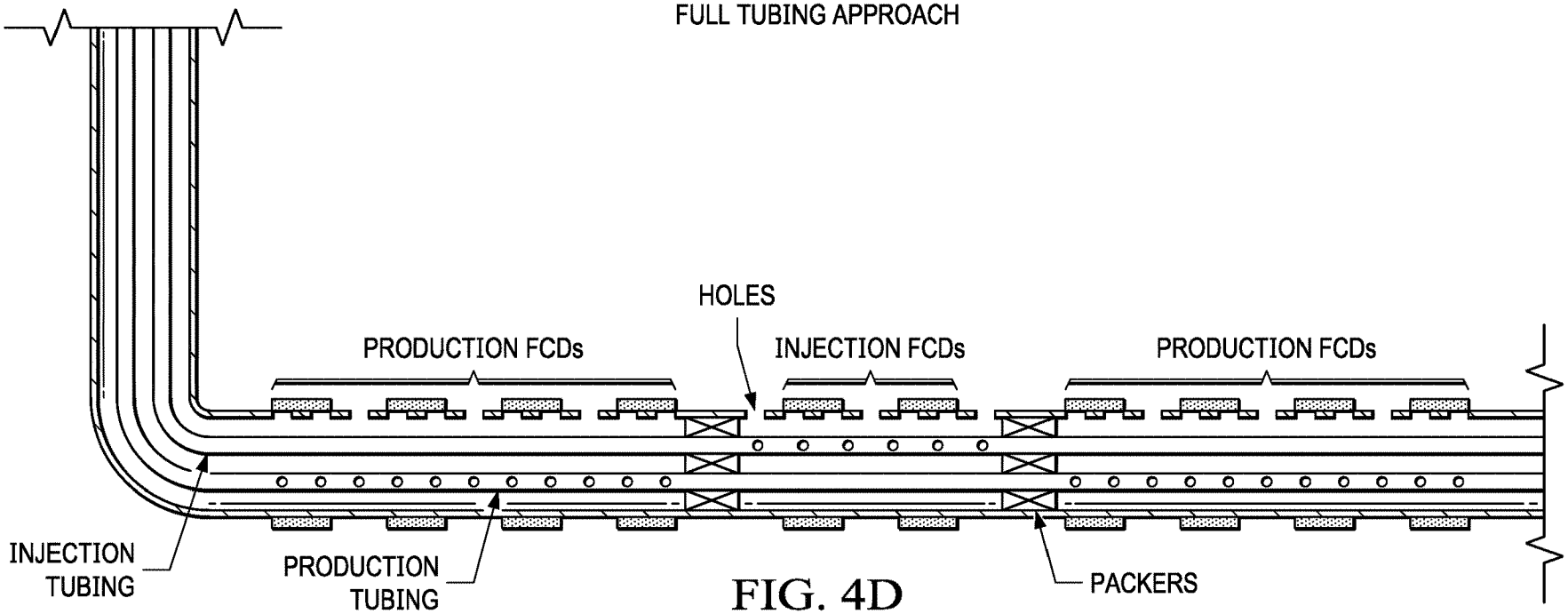

FIG. 3 shows schematically a simple, but effective (as demonstrated later by simulation) process modified from the conventional SW-SAGD, in which the steam injection point is placed in the middle of the horizontal well. The toe and heel sections of the horizontal well, isolated from the steam injection portion by thermal packers (indicated by the boxes with the X therein) within the wellbore, are perforated and serve as producer to collect heated oil and condensed water.

As illustrated in FIG. 3, the steam chamber can now grow from both sides, with the effective thermal and drainage interfaces virtually doubled. Consequently, the effective production well length is doubled, resulting in a significant uplift in oil production rate.

MPSW-SAGD

To further improve the performance SW-SAGD, multiple steam injection points can be introduced into the wellbore to initiate and grow a serial of steam chambers simultaneously. FIG. 4 gives an example with two injection points, one at ¼ well length from the heel and the other ¾ well length from the heel. The SW-SAGD with multiple steam injection points can significantly accelerate the oil recovery by engaging more well length into effective production. With two injection points as placed in FIG. 4, the dual steam chambers will each grow in both directions, and meet in roughly the middle of the well.

The number of the steam injection points and intervals between them non rally need to be determined and optimized based on the reservoir properties and economics. It is worth pointing out that implementing multiple steam injection points within a single wellbore adds complexity to the wellbore design and consequently well cost, necessitating the providing of multiple injections points and additional packers. Nevertheless, the proposed invention presents a considerable potential for improving SW-SAGD applications to thin-zone bitumen reservoirs.

Steam Chamber Simulations

To evaluate the performance of the proposed modification to the conventional SW-SAGD, numerical simulation with a 3D homogeneous model was conducted using Computer Modeling Group® Thermal & Advanced Processes Reservoir Simulator, abbreviated CMG-STARS. CMG-STARS is the industry standard in thermal and advanced processes reservoir simulation. It is a thermal, k-value (KV) compositional, chemical reaction and geomechanics reservoir simulator ideally suited for advanced modeling of recovery processes involving the injection of steam, solvents, air and chemicals.

The reservoir simulation model was provided the average reservoir properties of Athabasca oil sand, with an 800 m long horizontal well placed at the bottom of a 20 m pay. The simulation considered three cases, the conventional SW-SAGD, CPSW-SAGD with centered injector, and MPSW-SAGD with two injectors (one 200 m and the other 600 m from heel). A smaller than usual grid size was modeled in order to capture the effects (e.g., 1-5 m, preferably 2 m). No startup period was modeled. The modeled operational conditions, including pressure and injection rates, were similar to a typical SAGD operation.

Figure 5:
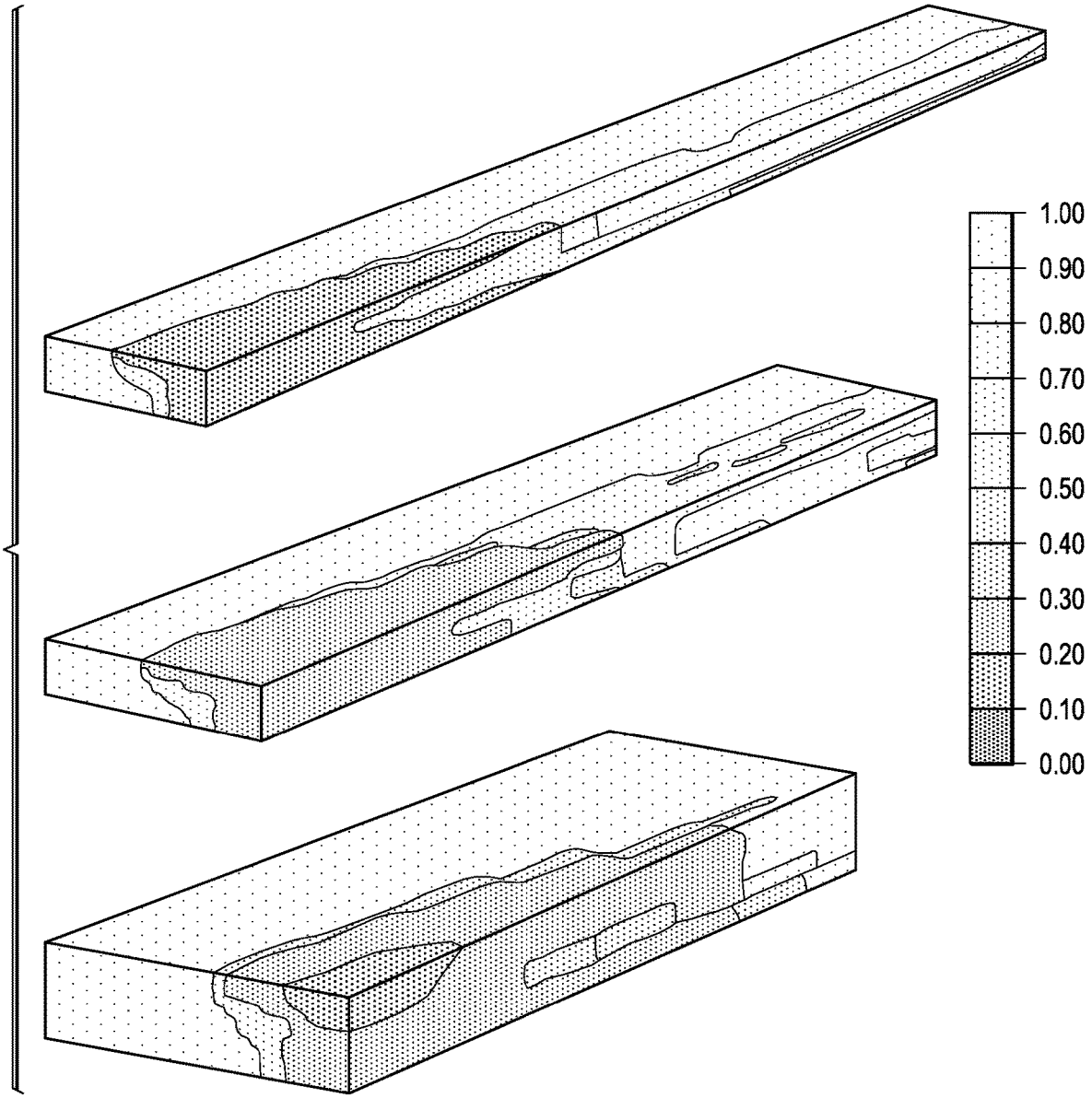
FIG. 5 shows simulated oil saturation profiles of (A) conventional SW-SAGD, (B) SW-SAGD with center injection point (half of full well length shown), and (C) SW-SAGD with two injection points (quarter of full well length shown) after 3 years of steam injection. All simulations performed with CMG-STARS using a fine grid block.
Figure 6:
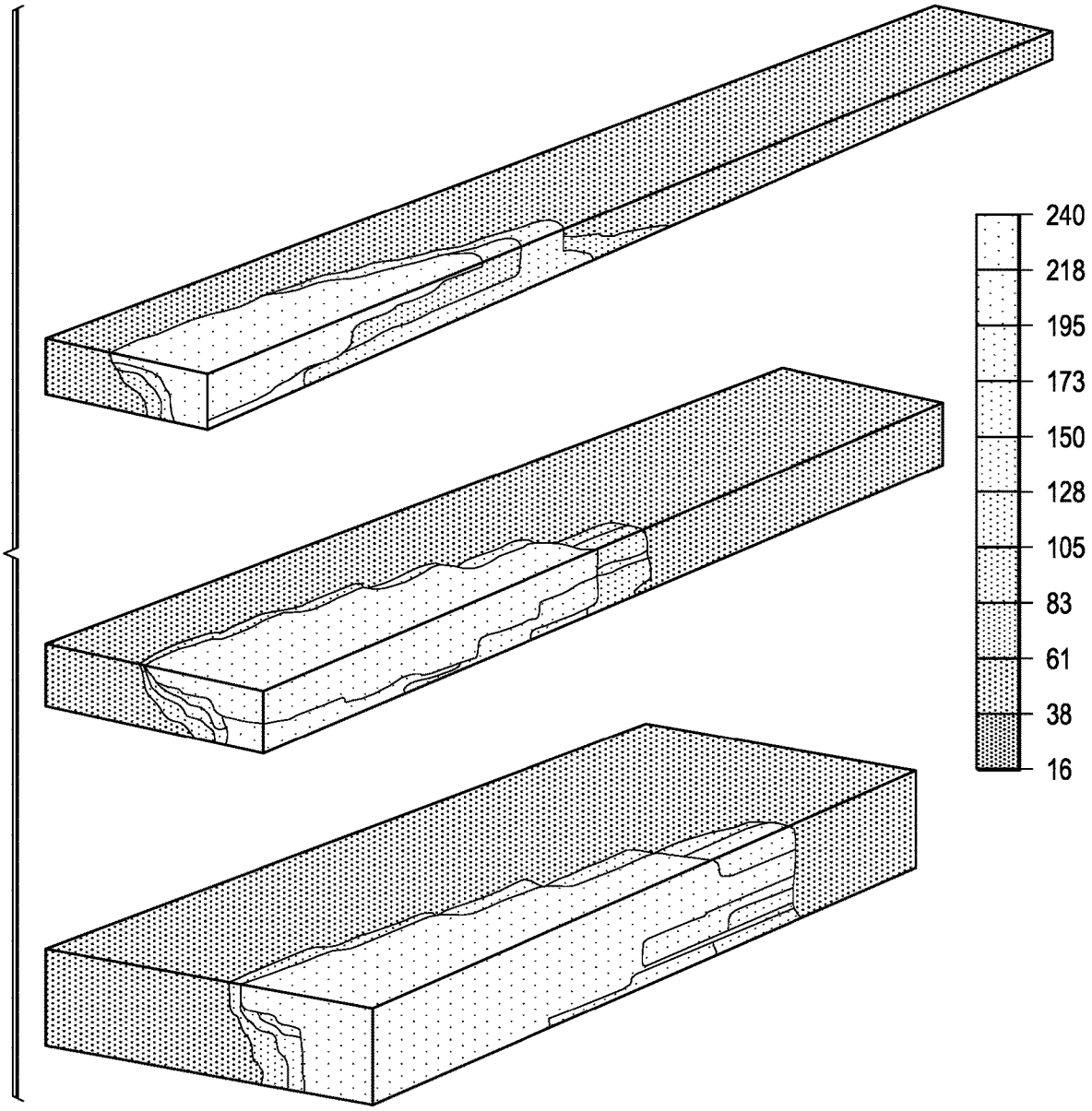
FIG. 6 shows simulated temperature profiles of (A) conventional SW-SAGD, (B) CPSW-SAGD with center injection point (half of full well length shown), and (C) MPSW-SAGD with two injection points (quarter of full well length shown) after 3 years of steam injection.

FIGS. 5 and 6 show the simulated profiles of oil saturation and temperature after 3-year steam injection for the three cases. Note that due to element of symmetry, the case of the SW-SAGD with centered injection point only shows one half of the well length and the case of the SW-SAGD with two injection points shows a quarter of the well length.

For the conventional SW-SAGD, the steam chamber extends to about ⅓ of the well length, leaving ⅔ of the well length not in production. The case with centered steam injection point results in steam chamber development over half of the well length and the case with two injection points show the steam zone over almost 80% of the well length. Thus, simply moving the steam injection point to the middle of the well, and by adding more than one injection point, the steam zone can cover the entire well.

Production Simulations

Figure 7:
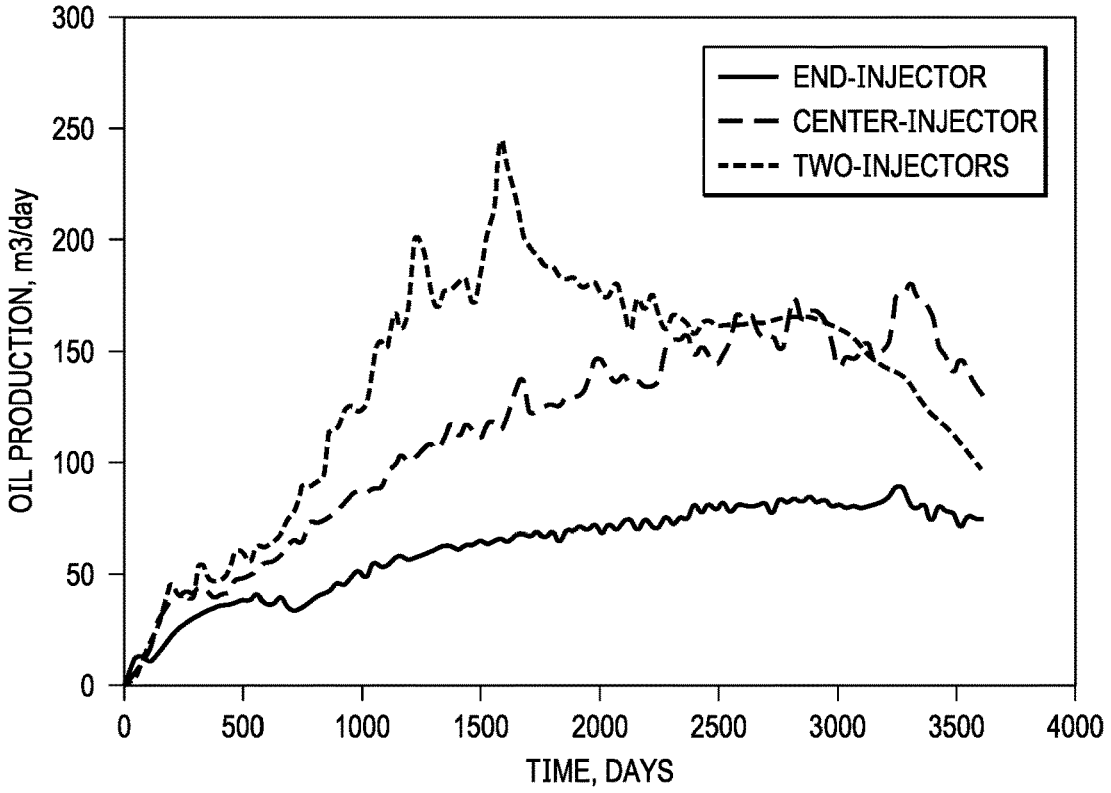
FIG. 7 shows a comparison of oil production rate. Note that the End-Injector case is conventional SW-SAGD, the Center-Injector case is CWSW-SAGD with a center injection point, and the Two-Injector case is MPSW-SAGD with two injection points spaced for equally sized steam chambers.
Figure 8:
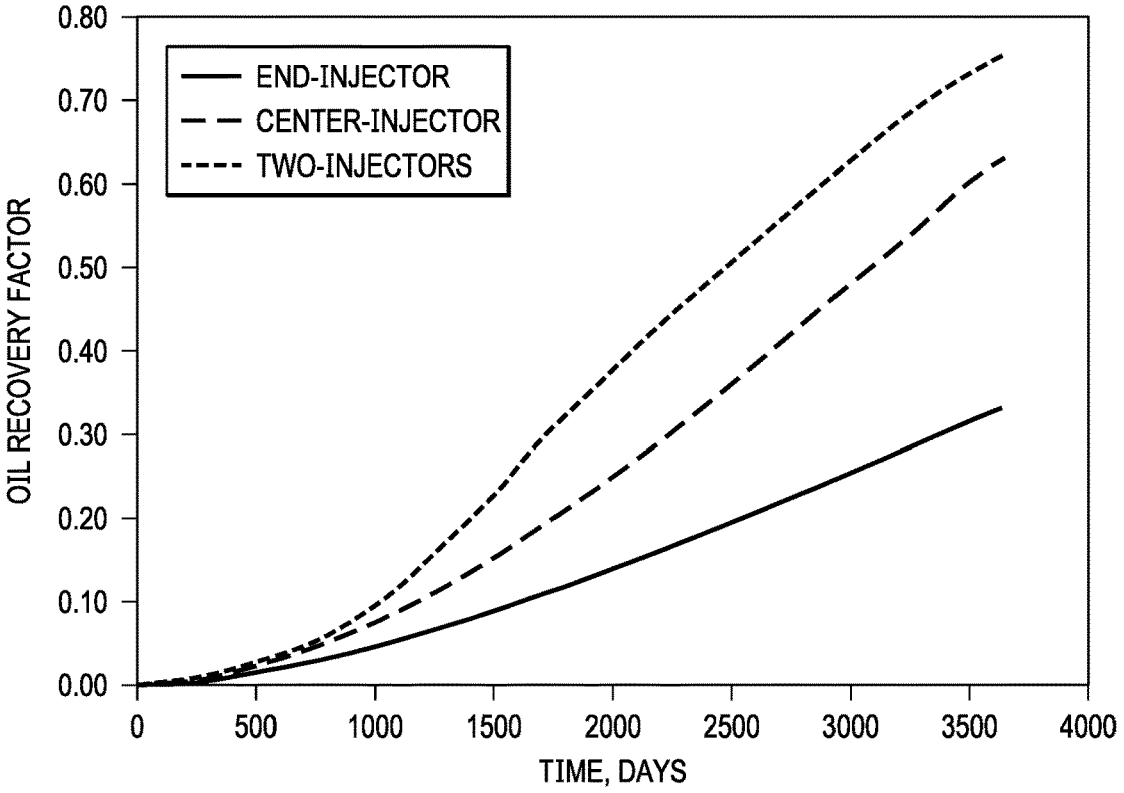
FIG. 8 is a comparison of oil recovery using the same three well configurations as in FIG. 7.

In order to prove the benefit of the CPSW-SAGD and MPSW-SAGD we performed production simulations, also using CMG-STARS. FIG. 7 compares the oil production rate of the three cases from above.

Surprisingly, the oil production rate is almost doubled from the conventional SW-SAGD by placing the injection point in the middle of the well, and is further lifted by 50% when two injection points are implemented.

The oil rate drop at 1600 days in the case with two injection points is due to the steam chamber coalescence. With two injection points, two steam chambers develop that are separated from each other at the beginning. As steam injection continues, both steam chambers will grow vertically and laterally. Depending on the distance between the two steam injection points, the edges of the two steam chambers will eventually meet somewhere in the mid-point, in a phenomena called "coalescence" of the steam chamber. The sum of surface area of the two chambers is larger before coalescence than after coalescence, because one of the boundaries is shared after coalescence. The heating of oil and resulting oil drainage depends on the surface or contact area. Therefore, it is typical that the oil rate drops when the steam chamber coalescences.

FIG. 5 shows the comparison of the oil recovery factor, which again illustrates the significant improvement of the described invention over the conventional SW-SAGD.

We have not yet run a simulation case with 3 injection points, but we expect even faster oil recovery. It is predicted that the wells can thereby be longer to fully realize the benefits of three injection points. Additional injection points can be added, particularly for longer lengths, but costs of completion will also increase, and thus optimization based on permeability, pressure, thickness of the pay, etc. is preferred.

The simulated payzone was big at 20 m. However, the relative gain really comes from the surface area increase due to doubling size of the incipient steam chambers. Thus, even with a thinner pay zone, we still expect the same relative performance improvement.

The following references are incorporated by reference in their entirety for all purposes.

Falk, K., et al., Concentric CT for Single-Well Steam Assisted Gravity Drainage, World Oil, July 1996, pp. 85-95.

McCormack, M., et al., Review of Single-Well SAGD Field Operating Experience, Canadian Petroleum Society Publication, No. 97-191, 1997.

Moreira R. D. R., et al., IMPROVING SW-SAGD (SINGLE WELL STEAM ASSISTED GRAVITY DRAINAGE), Proceedings of COBEM 2007 19th International, Congress of Mechanical Engineering, available online at www.abcm.org.bript/wpcontent/anais/cobem/2007/pdf/COBEM2007-0646.pdf.

Faculdade de Engenharia Mecanica, Universidade estadual de Campinas.

Sa SPE-59333 (2000) Ashok K. et al., A Mechanistic Study of Single Well Steam Assisted Gravity Drainage.

SPE-54618 (1999) Elliot, K., Simulation of early-time response of single well steam assisted gravity drainage (SW-SAGD).

SPE-153706 (2012) Stalder, Test of SAGD Flow Distribution Control Liner System, Surmont Field, Alberta, Canada US2012004308 1 Single well steam assisted gravity drainage US520130213652 SAGD Steam Trap Control US20140000888 Uplifted single well steam assisted gravity drainage system and process U.S. Pat. No. 5,626,193 Method for recovering heavy oil from reservoirs in thin formations

We claim:

1. A method of producing heavy oil from a reservoir by single well steam and gravity drainage (SW-SAGD), said method comprising:

a) providing a horizontal well (not a wellpair) below a surface of a reservoir, said horizontal well being fitted for steam injection along its horizontal length;

b) said horizontal well having a toe end and a heel end and a middle therebetween at 25-75% of well length;

c) injecting steam into said horizontal length of said horizontal well for a start-up period of time until a steam chamber develops over said horizontal length;

d) after developing said steam chamber, converting said horizontal length of said horizontal well to have one or more injection segments and two or more production segments between said toe end and said heel end, wherein each injection segment is separated from an adjacent production segment by a packer and a blank joint lacking any holes or a sliding sleeve; and e) injecting steam into said injection segments and simultaneously producing mobilized heavy oil from said two or more production segments;

f) wherein said method produces more oil at a time point than a similar SW-SAGD well with steam injection only at a toe end of said similar SW-SAGD well.

2. The method of claim 1, wherein an injection point is at said middle at 45-55% of said well length.

3. The method of claim 1, wherein two injection points are at about ½ and ¾ of the horizontal length of said well.

4. The method of claim 1, wherein injected steam includes solvent.

5. The method of claim 1, wherein said method includes a cyclic preheating phase comprising a steam injection period along an entire length of the well followed by a soaking period.

6. The method of claim 5, including two cyclic preheating phases.

7. The method of claim 5, including three cyclic preheating phases.

8. The method of claim 7, wherein said soaking period is 10-30 days.

9. The method of claim 7, wherein said soaking period is 20 days.

10. A method of producing heavy oil from a reservoir by single well steam and gravity drainage (SW-SAGD), said method comprising:

a) providing a horizontal well (not a wellpair) below a surface of a reservoir;

b) said horizontal well being flat and having a toe end and a heel end and a middle therebetween at 25-75% of well length;

c) said horizontal well having one or more injection segments and two or more production segments between said toe end and said heel end, wherein each injection segment is separated from an adjacent production segment by a blank joint lacking any holes and a flow control device; and d) injecting steam into said injection segments and simultaneously producing mobilized heavy oil from said two or more production segments;

e) wherein said method produces more oil at a time point than a similar SW-SAGD well with steam injection only at a toe end of said similar SW-SAGD well;

f) wherein said method includes a preheating phase comprising a steam injection period along an entire horizontal length of said horizontal well until a steam chamber forms over said entire horizontal length before converting said horizontal well to have one or more injection segments and two or more production segments.

11. The method of claim 10, wherein an injection point is at said middle at 45-55% of said well length.

12. The method of claim 10, wherein two injection points are at about ¼ and ¾ of a horizontal length of said well.

13. The method of claim 10, wherein injected steam includes solvent.

14. The method of claim 10, wherein said converting comprises closing packers positioned between said injection segment(s) and said production segment(s).

15. The method of claim 10, wherein said converting comprises adding packers between said injection segment(s) and said production segment(s).

16. The method of claim 10, wherein said method includes a cyclic preheating phase comprising a steam injection period along said entire length followed by a soaking period.

17. The method of claim 16, including two cyclic preheating phases.

18. The method of claim 16, including three cyclic preheating phases.

19. The method of claim 18, wherein said soaking period is 10-30 days.

20. The method of claim 18, wherein said soaking period is 20 days.

21. A method of producing heavy oil from a reservoir by single well steam and gravity drainage (SW-SAGD), said method comprising:

a) providing a horizontal well (not a wellpair) below a surface of a reservoir, said horizontal well being fitted for steam injection along its horizontal length;

b) said horizontal well having a toe end and a heel end and a middle therebetween at 25-75% of well length;

c) injecting steam into said horizontal length of said horizontal well for a start-up period of time until a steam chamber develops over said horizontal length;

d) after developing said steam chamber, converting said horizontal length of said horizontal well to have one or more injection segments and two or more production segments between said toe end and said heel end, wherein each injection segment is separated from an adjacent production segment by one or more packer(s) and sliding sleeve(s);

e) injecting steam into said injection segments and simultaneously producing mobilized heavy oil from said two or more production segments;

f) moving said sliding sleeve(s) and repeating step e; and g) optionally repeating step f;

h) wherein said method produces more oil at a time point than a similar SW-SAGD well with steam injection only at a toe end of said similar SW-SAGD well and wherein less oil is lost behind a blind interval than a similar method without said sliding sleeve(s).

* * * * *